US008670685B2

(12) United States Patent
Nishida

(10) Patent No.: US 8,670,685 B2
(45) Date of Patent: Mar. 11, 2014

(54) MOUNTING METHOD OF CLEANING BLADE AND IMAGE FORMING APPARATUS HAVING CLEANING BLADE

(75) Inventor: Satoshi Nishida, Saitama (JP)

(73) Assignee: Konica Minolta Business Technologies, Inc, Tokyo (JP)

( * ) Notice: Subject to any disclaimer, the term of this patent is extended or adjusted under 35 U.S.C. 154(b) by 315 days.

(21) Appl. No.: 13/294,485

(22) Filed: Nov. 11, 2011

(65) Prior Publication Data

US 2012/0128384 A1 May 24, 2012

(30) Foreign Application Priority Data

Nov. 19, 2010 (JP) ..... 2010-258627

(51) Int. Cl.
*G03G 21/00* (2006.01)

(52) U.S. Cl.
USPC ..... 399/71; 399/123; 399/343; 399/350

(58) Field of Classification Search
USPC ..... 399/38, 71, 110, 123, 343, 350, 351; 15/1.51, 256.5, 256.51
See application file for complete search history.

(56) References Cited

U.S. PATENT DOCUMENTS

| | | | | |
|---|---|---|---|---|
| 7,783,210 | B2 * | 8/2010 | Thayer et al. | 399/34 |
| 7,937,034 | B2 * | 5/2011 | Thayer et al. | 399/350 |
| 7,938,528 | B2 * | 5/2011 | Thayer et al. | 347/103 |

FOREIGN PATENT DOCUMENTS

| | | |
|---|---|---|
| JP | 08-220936 | 8/1996 |
| JP | 2000-122498 | 4/2000 |

* cited by examiner

*Primary Examiner* — Hoan Tran
(74) *Attorney, Agent, or Firm* — Lucas & Mercanti, LLP

(57) ABSTRACT

A cleaning blade mounting method includes the steps of: moving a toner image carrier on which a toner layer is formed so that the toner layer reaches a cleaning position by a cleaning device; after bringing a tip of a cleaning blade into contact with the toner layer, bringing the tip into contact with the toner image carrier, mounting the cleaning blade to a temporary position with a second load lower than a first load that is a contact load at a time of an image formation; moving the cleaning blade with the second load from the temporary position to a final position at which a cleaning operation is carried out; bringing the cleaning blade with the first load into contact with the toner image carrier; and mounting the cleaning blade to the final position at the time of the image formation.

7 Claims, 5 Drawing Sheets

MOUNTING METHOD OF CLEANING BLADE AND IMAGE FORMING APPARATUS HAVING CLEANING BLADE

This application is based on Japanese Patent Application No. 2010-258627 filed on Nov. 19, 2010, which is incorporated hereinto by reference.

BACKGROUND OF THE INVENTION

The present invention relates to a mounting method of a cleaning blade for cleaning a toner image carrier in an electrophotographic process and an image forming apparatus for forming an image by electrophotographic process.

A rubber-made cleaning blade is often used as a cleaning unit for removing toner and others from a toner image carrier such as a photoconductor and intermediate transfer member in the electrophotographic process.

When a cleaning blade is mounted on the image forming apparatus, a cleaning failure may occur due to defective operation of the cleaning blade immediately after mounting. To be more specific, if the toner image carrier is moved with the tip edge of an unused cleaning blade kept in contact with the toner image carrier, the cleaning blade fails to move smoothly along the surface of the toner image carrier due to an increased frictional drag between the cleaning blade and toner image carrier. This will result in turning over of the cleaning blade or passing through of toner.

Some of the cleaning blades are used until the service life of the image forming apparatus expires. The other cleaning blades may be replaced during the operation before the service life of the image forming apparatus expires. The aforementioned problem also occurs during the replacement of the cleaning blade.

To solve the aforementioned problem arising immediately after mounting of the cleaning blade, the Japanese Patent Application Publication No. H8-220936 proposes a method of reducing the frictional drag between the mounted cleaning blade and toner image carrier by coating the toner image carver with a lubricant of zinc stearate and others.

To solve the aforementioned problem arising immediately after mounting of the cleaning blade, the Japanese Patent Application Publication No. 2000-122498 proposes a method of reducing the frictional drag between the mounted cleaning blade and toner image carrier by forming a toner layer on the toner image carrier.

According to the Japanese Patent Application Publication No. H8-220936, the toner image carrier is coated with lubricant. According to the Japanese Patent Application Publication No. 2000-122498, a toner layer is formed on the toner image carrier. However, in the Japanese Patent Application Publication Nos. H8-220936 and 2000-122498, the toner image carrier is moved only in one direction with the cleaning blade kept in contact with the toner image carrier after lubricant has been applied or the toner layer has been formed. Thus, the cleaning blade rubs against the surface of the toner image carrier without the frictional drag sufficiently reduced between the unused cleaning blade and toner image carrier. This will cause cleaning failures.

The present invention is intended to solve the aforementioned problem that may arise when cleaning blade is mounted or replaced. It is accordingly an object of this invention to ensure high cleaning performance and formation of a high-quality image.

SUMMARY OF THE INVENTION

The aforementioned object of the present invention can be achieved by the following structures.

1. To achieve at least one of the abovementioned objects, a mounting method of cleaning blade reflecting one aspect of the present invention, has: a step of forming a toner layer on a toner image carrier; a step of moving the toner image carrier so that the toner layer can reach the cleaning device for cleaning the image carrier; a step of contacting the tip end of the cleaning blade to be mounted to the toner image carrier after causing the aforementioned tip end to contact the toner layer, and mounting the cleaning blade at a temporary position under the second load which is lower than the first load as the contact load in the image formation; a step of moving the cleaning blade to be mounted under the second load from the temporary position to the final position for cleaning by the cleaning blade; and a step of contacting the cleaning blade to be mounted to the toner image carrier under the first load and mounting this blade at the final position as the position for image formation.

2. In the aforementioned Item 1 for mounting the cleaning blade, it is preferable to move the toner image carrier under the first load in the first direction as the traveling direction in the image formation, after the cleaning blade to be mounted has been mounted at the final position.

3. In the aforementioned Item 2 for mounting the cleaning blade, when moving the toner image carrier in the first direction, it is preferable to move the toner image carrier at a speed lower than that in the image formation.

4. In the aforementioned Item 2 or 3 for mounting the cleaning blade, it is preferable to implement the step of moving the toner image carrier in the direction opposite the first direction while the cleaning blade to be replaced is kept in contact with the toner image carrier, and the step of removing the cleaning blade to be replaced from the toner image carrier, before the step of mounting the temporary position.

5. An image forming apparatus has: a toner image carrier; a cleaning device wherein a plurality of cleaning blades can be removed from and can be moved relative to the toner image carrier, and the toner image carrier is cleaned by any one of the cleaning blades kept in contact with the toner image carrier on an selective basis; a toner layer forming section for forming a toner layer on the toner image carrier; an image carrier drive section for moving the toner image carrier in such a way that the toner layer formed on the toner image carrier moves relative to the cleaning device; and a controller for controlling the cleaning blade replacement operation. Here the controller controls: a step of allowing the toner layer forming section to form a toner layer on the toner image carrier; a step of allowing the image carrier drive section to move the toner image carrier so that the toner layer reaches the cleaning device; a step of retracting the cleaning blade to be replaced from the cleaning position; a step of contacting the tip end of the cleaning blade to be mounted to the toner image carrier after causing the aforementioned tip end to contact the toner layer; a step of mounting the cleaning blade at a temporary position on the toner image carrier under the second load which is lower than the first load as the contact load in the image formation; a step of moving the cleaning blade to be mounted under the second load from the temporary position to the final position wherein cleaning is performed by the cleaning blade; and a step of contacting the cleaning blade to be mounted under the first load to the toner image carrier, and mounting the cleaning blade at the final position for image formation.

6. In the image forming apparatus of the aforementioned Item 5, it is preferable that the controller should move the toner image carrier in the first direction as the traveling direction for the image formation under the first load, after the cleaning blade to be mounted has been mounted at the final position.

7. In the image forming apparatus of the aforementioned Item 6, it is preferable that, when moving the toner image carrier in the first direction, the controller should move the toner image carrier at a speed lower than that in the image formation.

DETAILED DESCRIPTION OF THE PREFERRED EMBODIMENT

The following describes the present invention with reference to embodiments, without being restricted thereto.

Figure 1:
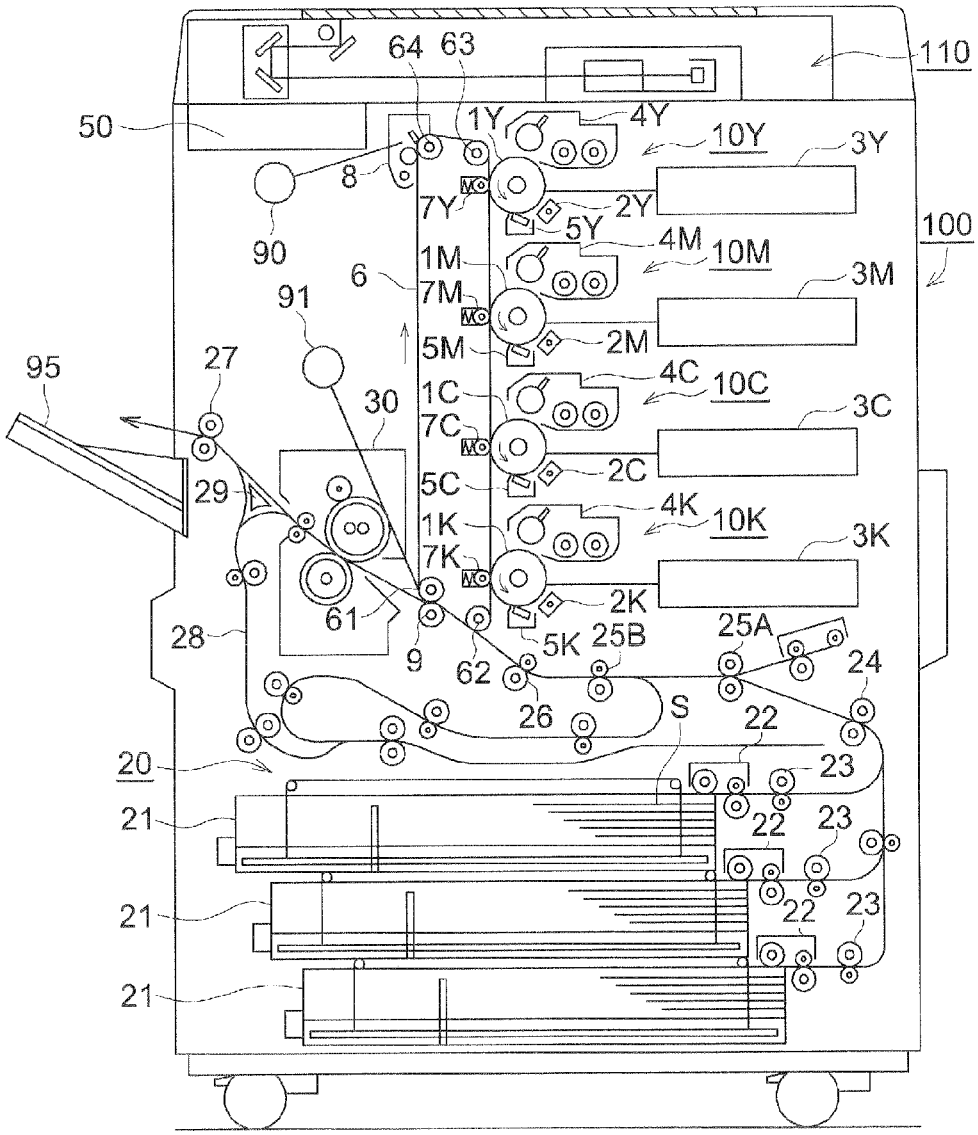
FIG. 1 is an overall view representing the image forming apparatus in an embodiment of the present invention.

FIG. 1 is an overall view representing the image forming apparatus 100 in an embodiment of the present invention.

The image forming apparatus 100 is what is called a tandem type image forming apparatus, and is made up of a plurality of sets of image forming sections 10Y, 10M, 10C and 10K, endless belt-like like intermediate transfer member 6, sheet feeding device 20, fixing device 30, operation section 50 and others.

A scanner 110 is installed on the upper portion of the image forming apparatus 100. The document placed on the document platen has its image scanned by the document image scanning optical system of the scanner 110, and the image is captured into the line imaging sensor. The controller allows analog processing, A/D conversion, shading correction and image compression to be applied to the analog signal subjected to photoelectric conversion by the line imaging sensor. After that, the signal is inputted to the exposing sections 3Y, 3M, 3C and 3K.

The image forming apparatus 100 includes an image forming section 10Y for forming a yellow (Y) image, image forming section 10M for forming a magenta (M) image, image forming section 10C for forming a cyan (C) image, image forming section 10K for forming a black (K) image, an endless belt-like intermediate transfer member 6 arranged opposed to the image forming sections 10Y, 10M, 10C and 10K, fixing device 30, and sheet feeding device 20 and both-side conveyance path 28.

The image forming section 10Y includes a drum-shaped photoconductor 1Y, charging electrode 2Y, exposing section 3Y, developing section 4Y, and cleaning device 5Y. The image forming section 10M includes a drum-shaped photoconductor 1M, charging electrode 2M, exposing section 3M, developing section 4M and cleaning device 5M. The image forming section 10C has a drum-shaped photoconductor 1C, charging electrode 2C, exposing section 3C, developing section 4C and cleaning device 5C. The image forming section 10K has a drum-shaped photoconductor 1K, charging electrode 2K, exposing section 3K, developing section 4K and cleaning device 5K.

The photoconductors 1Y, 1M, 1C and 1K are made up of the organic photoconductor wherein the photosensitive layer formed of resin containing organic photoconductor, for example, is formed on the outer peripheral surface of the drum-shaped metallic substrate. These photoconductors are arranged to extend across the sheet S to be conveyed (in the perpendicular direction to the page in FIG. 1).

The developing sections 4Y, 4M, 4C and 4K contain two-component developer made up of small-diameter toners and carriers of yellow (Y), magenta (M), cyan (C) and black (K) colors.

The endless belt-like intermediate transfer member 6 as the toner image carrier are rotatably supported by a plurality of rollers 61, 62, 63 and 64. The intermediate transfer member 6 is an endless belt having a specific volume resistance of $10^6$ through $10^{12}\Omega\cdot$cm. One example is a semiconductor seamless belt having a thickness of 0.04 through 0.10 mm made of engineering plastics such as denatured polyimide, thermosetting polyimide, ethylene tetrafluoro ethylene copolymer, vinylidene polyfluoride and nylon alloy wherein conductive material is dispersed.

The toner images of various colors formed on the photoconductor 1 by the image forming sections 10Y, 10M, 10C and 10K are sequentially transferred onto the rotating intermediate transfer member 6 (primary transfer) by the primary transfer units 7Y, 7M, 7C and 7K, so that a compound color image is formed. In the meantime, the photoconductors 1Y, 1M, 1C and 1K subsequent to image transfer are cleaned by the cleaning devices 5Y, 5M, 5C and 5K.

The primary transfer units 7Y, 7M, 7C and 7K press the intermediate transfer member 6 against the photoconductors 1Y, 1M, 1C and 1K so that a nip is formed between the intermediate transfer member 6 and photoconductor 1.

The image forming section 10K and primary transfer unit 7K constitute the toner layer forming section for forming the toner layer on the intermediate transfer member 6 when the cleaning blade is mounted.

The sheets S accommodated in the sheet storing section (tray) 21 of the sheet feeding device 20 are fed by the first sheet feed section 22. These sheets are conveyed to the secondary transfer section 9 through the sheet feed rollers 23, 24, 25A and 25B and registration roller (the second sheet feed section) 26, and the color image is transferred to the sheets S (secondary transfer).

The components of the three-stage sheet storing section 21 arranged in a single file perpendicularly below the image forming apparatus 100 have one and the same structure and are assigned with the same reference numerals. The components of the three-stage sheet feed section 22 also have one and the same structure and are assigned with the same reference numerals. The sheet storing section 21 and sheet feed section 22 are collectively called a sheet feeding device 20.

The sheets S with the color image transferred thereon are interposed by the fixing device 30, and are provided with heat and pressure so that color toner images are fixed on these sheets S. The sheets S with the color image fixed thereon are ejected from the sheet ejection roller 27 provided on the sheet ejection conveyance path and are placed on the sheet ejection tray 95 outside the machine.

In the meantime, after color toner images are transferred onto the sheets S by the secondary transfer section 9, the sheets S are subjected to curvature-separation by the intermediate transfer member 6, which is cleaned by the cleaning device 8. Thus, toner is removed from the intermediate transfer member 6.

In the duplex copy mode, after the images formed on the first surface of the sheets S have been fixed, the sheets S are branched off from the sheet ejection conveyance path by the branching plate 29, and are introduced into the double-side conveyance path 28. These sheets are reversed and are again conveyed from the sheet feed roller 25B. The image of various colors are formed on the second surface of the sheets S by the image forming sections 10Y, 10M, 10C and 10K and are heated and fixed by the fixing device 30. These sheets are then ejected to the sheet ejection tray 95 by the sheet ejection roller 27.

Numeral 90 indicates a motor as a blade drive section for moving the cleaning blade when the cleaning blade is replaced, and 91 denotes a motor as an image carrier drive section for moving the intermediate transfer member 6 at the times of image formation and cleaning blade replacement.

In the cleaning device 8, the cleaning blade is mounted and replaced. To be more specific, when the image forming apparatus is manufactured, the unused cleaning blade is mounted on the cleaning device 8. When a prescribed operation time has expired or the number of sheets with images formed thereon has reached a prescribed level, the cleaning blade is regarded as requiring replacement due to reduced cleaning performances resulting from long-term operation, and is replaced by a new cleaning blade.

In the operation section 50, various conditions required for image formation and cleaning blade replacement mode are set.

FIGS. 2A-2D and 3A-3B show the cleaning blade replacement process.

The cleaning device 8 for cleaning the intermediate transfer member 6 as a toner image carrier has a cleaning blade made up of rubber such as urethane rubber as a cleaning unit. The cleaning device 8 uses the cleaning blade to clean the intermediate transfer member 6, and removes toner from the intermediate transfer member 6. The cleaning blade has an edge on the tip portion and makes counter-contact in such a way as to form a sharp angle with respect to the surface of the intermediate transfer member 6 downstream in the traveling direction of the intermediate transfer member 6. When the intermediate transfer member 6 travels, the toner on the intermediate transfer member 6 is scraped off by the cleaning blade edge, so that the intermediate transfer member 6 is cleaned.

The present invention can be applied to mounting of the cleaning blade for cleaning the photoreceptor as a toner image carrier, as well as to the image forming apparatus.

The tip end of the cleaning blade will be worn due to long-term operation, and the cleaning performance will be deteriorated. The worn-out blade is replaced by a new one.

The following describes the method for mounting and replacing the cleaning blade. In the operation section 50 of FIG. 1, the cleaning blade replacement is started by a replacement worker operating the system in the cleaning blade replacement mode.

Step a:

When the image forming apparatus has been set to the cleaning blade replacement mode, the toner layer of a solid black image is formed on the photoconductor 1K (FIG. 1) of the image forming section 10K (FIG. 1), and is transferred onto the intermediate transfer member 6. The toner layer on the inter mediate transfer member 6 is formed in the following process. The photoconductor 1K is subjected to full-surface exposure to a width of 100 mm in the traveling direction of the photoconductor 1K by the exposing section 3K. Development is made by the developing section 4K, and the formed solid image is transferred onto the intermediate transfer member 6 by the primary transfer unit 7K. As described above, the toner layer forming section for forming the toner layer on the intermediate transfer member 6 is made of the image forming section 10K and primary transfer unit 7K.

Figure 2A:
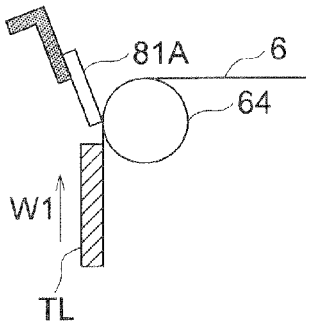
FIGS. 2A-2D are diagrams showing the cleaning blade replacement process.

Step a1:

The intermediate transfer member 6 is driven by the motor 91 in the first direction W1 which is the traveling direction in the image formation. As shown in FIG. 2A, the intermediate transfer member 6 is suspended when the toner layer TL has moved to the position upstream of the cleaning blade 81A to be replaced.

Figure 2B:
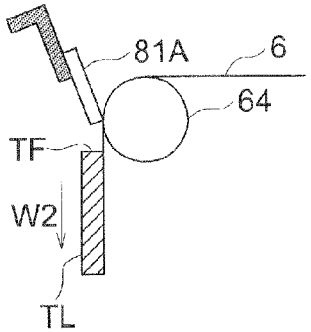

Step a2:

As shown in FIG. 2B, the intermediate transfer member 6 is driven by the motor 91 in the second direction W2 opposite the first direction W1 so that the tip front TF of the toner layer TL is a prescribed distance, for example, 10 mm, apart from the cleaning blade 81A to be replaced. This movement ensures toner to be removed from the cleaning blade 81A to be replaced. The used cleaning blade 81A to be replaced will be referred to merely as a cleaning blade 81A.

This procedure minimizes the possibility of the toner being sent flying or the hands or cloths of the replacement worker being contaminated when the cleaning blade 81A is removed.

Figure 2C:
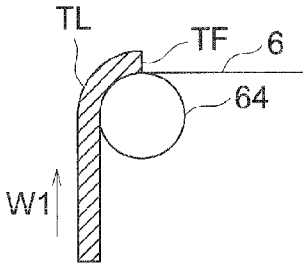
Figure 2D:
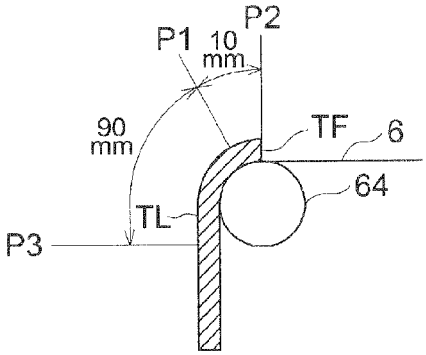

Step b:

The cleaning blade 81A is removed and is set apart from the intermediate transfer member 6. The intermediate transfer member 6 is moved a prescribed distance in the first direction until the state of FIG. 2C will be reached. The cleaning blade 81A is set apart from the intermediate transfer member 6 either by the manual operation of the replacement worker or by a blade drive section (not illustrated). FIG. 2D shows the relationship between the position wherein the cleaning blade 81B is mounted and the position of the toner layer TL set so as to reach the state of FIG. 2C. The unused cleaning blade 81B to be mounted will be referred to merely as a cleaning blade 81B.

In FIG. 2D, the position P1 wherein the tip edge of the cleaning blade 81B contacts the intermediate transfer member 6 is slightly inside the toner layer TL from the position P2 as the tip front TF of the toner layer TL. Generally, the length of the toner layer TL between the positions P1 and P2 is 10 mm. The length of the toner layer between the position P3 on the rear end of the toner layer TL and position P1 is generally set at 90 mm. The position P1 is a temporary position on the intermediate transfer member 6 wherein the cleaning blade 81B is mounted temporarily.

Figure 3A:
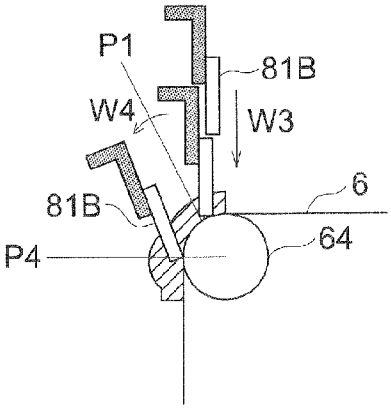
FIGS. 3A-3B are diagrams showing the cleaning blade replacement process.

Step c:

The cleaning blade 81B is lowered in the third direction W3 which is the blade mounting direction in FIG. 3A, so that the tip end is brought in contact with the intermediate transfer member 6. As will be apparent from FIG. 3A, the cleaning blade 81B to be mounted contacts the intermediate transfer member 6 after having contacted the toner layer TL. This arrangement allows the cleaning blade 81B mounted at the temporary position P1 when the toner is present between the unused cleaning blade 81B and intermediate transfer member 6. The cleaning blade 81B is mounted at the temporary position P1 by the operation of the replacement worker or by the blade drive section.

Step d:

The cleaning blade 81B is moved in the direction W4 from the temporary position P1 to the position P4 wherein the blade operates as a cleaning unit in the image formation. The position P4 provides a final position wherein tip edge of the cleaning blade 81B contacts the intermediate transfer member 6 to start cleaning in the image formation. The cleaning blade 81B is moved to the final position P4 by the operation of the replacement worker or by the blade drive section.

In the process of FIG. 3A wherein the blade is mounted at the temporary position P1 and is moved from the temporary position P1 to the final position P4, the cleaning blade 81B contacts the intermediate transfer member 6 under the second load which is lower than the load in the cleaning mode. In one example, the first load as the load of the cleaning blade in the cleaning of the image formation process is 20N. By contrast, the second load of the cleaning blade 81B in the process of movement in FIG. 3A is set at a value below 5N. When the cleaning blade 81B is moved from the temporary position P1 to the final position P4, a pool of toner is formed upstream of the tip end of the cleaning blade 81B, as illustrated. A sufficient amount of toner is deposited on the tip end of the cleaning blade 81B. In the Step d wherein the cleaning blade 81B is moved from the temporary position P1 to the final position P4, there is a relative movement of the intermediate transfer member 6 and cleaning blade 81B. As illustrated, the intermediate transfer member 6 can be moved in the first direction W1 by the motor 91 instead of the cleaning blade 81B being moved in the direction W4 by the motor 90 (FIG. 1). Thus, the direction W4 is also the first direction.

If the cleaning blade is moved on the intermediate transfer member 6 without a sufficient amount of toner deposited on the tip end of the cleaning blade, the cleaning blade is pulled toward the intermediate transfer member 6 by frictional drag between the cleaning blade and intermediate transfer member 6. This may result in a less smooth movement between the cleaning blade and intermediate transfer member 6. To avoid this, the blade is moved on the intermediate transfer member 6 after the toner has been deposited on the cleaning blade. In the Step of FIG. 3A, the cleaning blade 81B is brought under the lower second load in contact with the intermediate transfer member 6 carrying the toner layer TL, and the cleaning blade 81B is moved relative to the intermediate transfer member 6. Thus, toner is deposited on the tip end of the cleaning blade 81B, with the toner present between the cleaning blade 81B and intermediate transfer member 6. This eliminates the possibility of the intermediate transfer member 6 being dragged by the friction of the tip end of the cleaning blade 81B during the movement of the cleaning blade 81B, as shown in FIG. 3A.

The step of mounting the cleaning blade 81B on the cleaning device by moving the blade along the locus illustrated in FIG. 3A and increasing the contact load of the cleaning blade 81B from the second to the first load can be implemented by guiding the cleaning blade 81B by a guiding device (not illustrated) installed on the cleaning device.

When the cleaning blade 81B is mounted on the final position P4, the load of the cleaning blade 81B is set at the first load which is the load in the image formation. This allows the cleaning blade 81B to contact the intermediate transfer member 6 in the deflected state as illustrated in FIG. 3B.

Figure 3B:
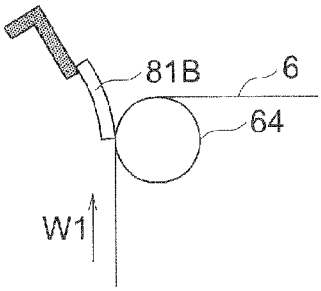

Step e:

After the cleaning blade 81B has been mounted at the final position P4 of FIG. 3B under the first load, the intermediate transfer member 6 is driven a prescribed distance in the first direction W1 by the motor 91.

The traveling speed at this time is decreased compared to that in the image formation. In one example, the traveling speed of the intermediate transfer member 6 at the time of image formation is 300 mm/sec. By contrast, the traveling speed of Step e is set at 100 mm/sec.

In Step e, formation of a pool of toner at the tip end of the cleaning blade 81B is pushed to a further advanced state, and effectively prevents turning over of the cleaning blade or passing through of toner that occurs immediately after cleaning blade replacement. Further, when the traveling speed of the intermediate transfer member 6 is reduced below that in the image formation in Step e, turning over of the cleaning blade is prevented.

Of the aforementioned Steps a through e, the Steps a, b, c and d are important in the present invention. Steps a1, a2 and part of the Step b (removal of the used blade) are implemented at the time of blade replacement to be performed when the cleaning blade to be replaced is removed and the cleaning blade to be mounted is mounted.

The Step e is preferable to ensure greater stability of the cleaning performance.

Figure 4:
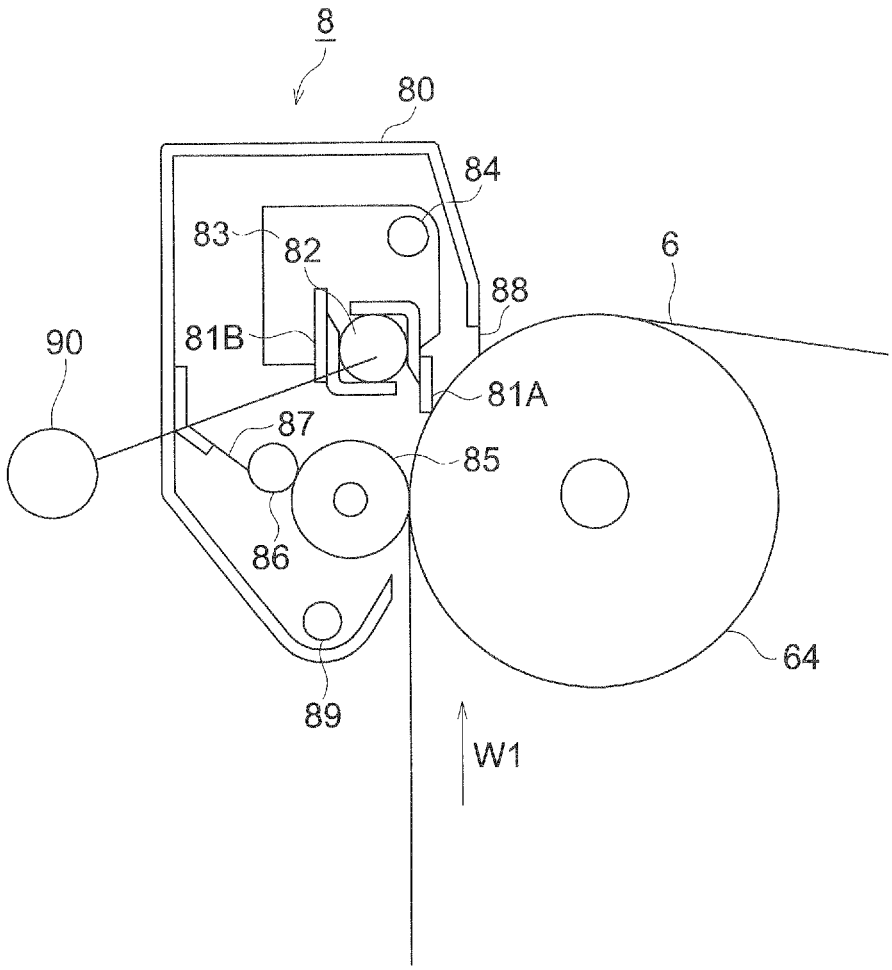
FIG. 4 is a diagram showing the cleaning device 8 wherein the cleaning blade is replaced automatically.
Figure 5:
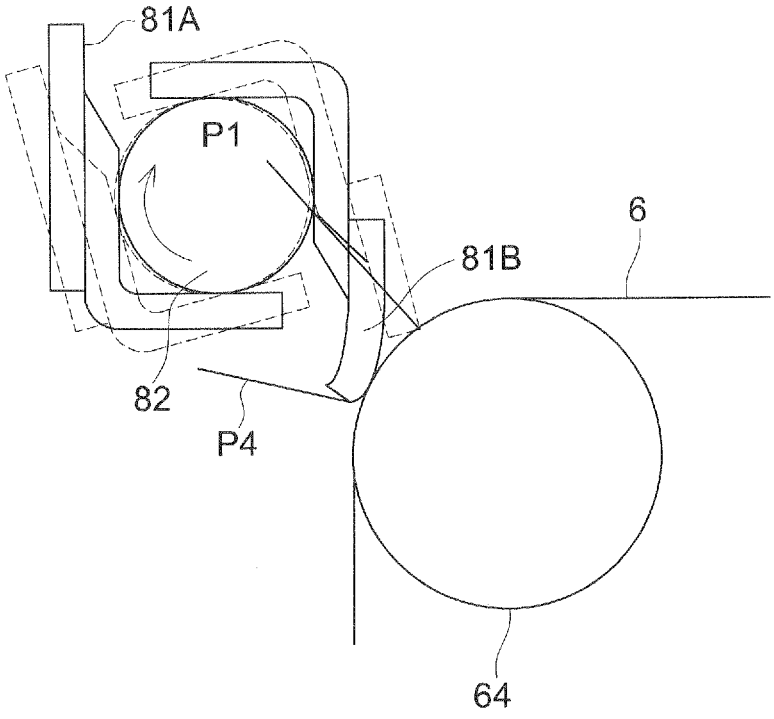
FIG. 5 is a diagram showing the major components of the cleaning device 8 wherein the cleaning blade is replaced automatically.
Figure 6:
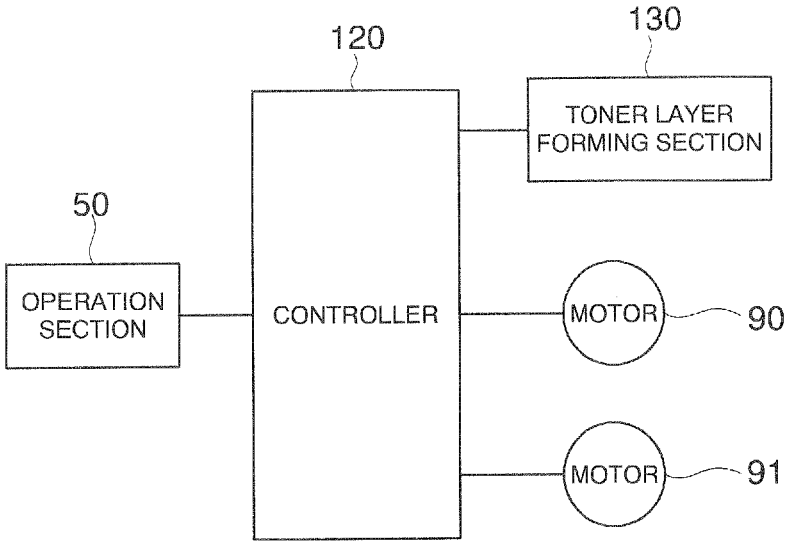
FIG. 6 is a block diagram showing the control system to perform automatic replacement of the cleaning blade.

FIG. 4 shows the cleaning device 8 wherein the cleaning blade is replaced automatically. FIG. 5 shows the major components of the cleaning device 8 of FIG. 4. FIG. 6 is a block diagram showing the control system to perform automatic replacement of the cleaning blade.

The cleaning device 8 is provided with a plurality of cleaning blades. In the cleaning device 8 of FIGS. 4 and 5, the reference numeral 81A indicates a cleaning blade to be replaced, and 81B represents a cleaning blade to be mounted. The cleaning blade 81A and cleaning blade 81B are mounted symmetrically on the shaft 82. The cleaning blade 81A or cleaning blade 81B abuts on intermediate transfer member 6 by the rotation of the shaft 82. In FIG. 4, the cleaning blade 81A contacts the intermediate transfer member 6. In FIG. 5, the cleaning blade 81B contacts the intermediate transfer member 6. The shaft 82 is supported by the supporting plate 83, and the supporting plate 83 is rotatably supported by the shaft 84.

During the maintenance of the cleaning device 8, the supporting plate 83 rotates about the shaft 84 clockwise to increase a space between the cleaning device 8 and intermediate transfer member 6.

The cleaning device 8 is enclosed almost completely by a housing 80 and shielding piece 88 except the opening on the side of the intermediate transfer member 6. The numeral 85 is a cleaning blush, 86 is a tapping member for removing toner from the cleaning blush 85, numeral 87 is a scraper for removing toner from the tapping member 86, numeral 89 is a conveyance member for conveying toner out of the cleaning device 8, numeral 90 is a motor as a blade drive section for rotating and driving the shaft 82, and numeral 91 is a motor as an image carrier drive section.

At the time of image formation when the intermediate transfer member 6 is cleaned by the cleaning device 8, the cleaning blush 85 is set at the illustrated position and is brought into contact with the intermediate transfer member 6 to clean the intermediate transfer member 6.

When the cleaning blade replacement mode is set in the operation section 50, the cleaning blush 85 is set apart from the intermediate transfer member 6. The cleaning blush 85 is set apart by the brush moving unit (not illustrated) such as a solenoid.

Immediately before the start of the replacement process, the cleaning blade 81A comes into contact with the intermediate transfer member 6, namely, the cleaning blade 81A is mounted at the position illustrated in FIG. 4.

The controller 120 drives the toner layer forming section 130 to form a toner layer band of a prescribed width on the intermediate transfer member. As described above, the toner layer forming section 130 is made up of an image forming section 10K and primary transfer unit 7K.

When the cleaning blade 81A is kept in contact with the intermediate transfer member 6, the toner layer forming section 130 forms a band-shaped toner image TL (FIGS. 2A-2D) of a prescribed width extending in the direction perpendicular to the traveling direction of the intermediate transfer member 6. Then the controller 120 drives the motor 91 to move the intermediate transfer member 6 in the second direction W2 so that the toner layer TL is kept apart from the cleaning blade 81A and the state illustrated in FIG. 2B is reached.

The controller 120 then drives the motor 90 to rotate the shaft 82 clockwise shown by arrow. The cleaning blade 81A goes apart from the intermediate transfer member 6 to stay in the standby position. In addition to causing the cleaning blade 81A to retract to the standby position from the intermediate transfer member 6, the controller 120 drives the motor 91 to move the intermediate transfer member 6 in the first direction W1 and to move the toner layer on the intermediate transfer member 6 to the blade tip end abutting position. To put it another way, the state of FIG. 2C is reached.

The controller 120 then drives the motor 90 to rotate the shaft 82 clockwise until the tip end of the cleaning blade 81B abuts on the intermediate transfer member 6. The abutting position of the cleaning blade 81B is the temporary position P1 shown in FIG. 2D. In FIG. 5, the cleaning blade 81B in contact to the temporary position P1 is indicated by a dotted line. The drive of the motor 90 further rotates the shaft 82 so that the cleaning blade 81B moves to the final position P4 of FIG. 3A. In the traveling process of the cleaning blade 81B, there is a gradual increase in the contact load of the cleaning blade 81B. The cleaning blade 81B stops at the final position P4 (indicated by a solid line in FIG. 5) of FIG. 3A, and is set at the final position. The final position P4 is where the intermediate transfer member 6 is cleaned by the cleaning blade 81B in the process of image formation.

Referring to FIG. 5, the following describes a change in the contact load of the cleaning blade 81B.

In FIG. 5, the dotted line indicates that the cleaning blade 81B contacts the intermediate transfer member 6 at the temporary position P1. When the motor 90 is driven, the shaft 82 rotates clockwise shown by arrow, and the cleaning blade 81B moves to the final position P4 of the solid line. Then the cleaning blade 81B pushes the toner layer TL (FIGS. 2A-2D) so that a pool of toner is formed upstream of the cleaning blade 81B. The cleaning blade 81B contacts the intermediate transfer member 6 under the second load which gradually increases from the minimum level at the temporary position P1 indicated by the dotted line of FIG. 5. The contact load reaches the maximum first load at the final position P4, with the result that the cleaning blade 81B is deflected as illustrated.

The first load is the load when the cleaning blade 81B contacts the intermediate transfer member 6 in the image formation.

As described above, in the embodiment shown in FIGS. 4 and 5, in the process of the movement of the cleaning blade 81B from the temporary position P1 to the final position P4, there is a gradual increase in the second load lower than the first load as a load for cleaning by the cleaning blade 81B in the image formation. The cleaning blade 81B contacts the intermediate transfer member 6 at the final position P4 under the first load higher than the second load. The motor 91 is then driven so that the intermediate transfer member 6 moves a prescribed distance in the first direction W1. Thus, a pool of a sufficient amount of toner is formed upstream of the cleaning blade 81B.

In the embodiment of FIGS. 4 and 5, the movement of the cleaning blade 81B is employed to move the cleaning blade 81B from the temporary position to the final position. It is also possible to move the intermediate transfer member 6 by the drive of the motor 91. In this case, the abutting angle of the cleaning blade 81B is changed by the blade drive section (not illustrated) when the cleaning blade 81B has been set at the final position, and the load is changed from the second load to the first load.

In the present embodiment, when mounting the cleaning blade to be mounted, a toner layer is formed on the toner image carrier. After the cleaning blade to be mounted has contacted the toner image, the blade contacts the toner image carrier, and the cleaning blade to be mounted is mounted at the temporary position. When the cleaning blade to be mounted is moved from the temporary position to the final position as the position for image formation in the first direction as the traveling direction in the image formation, the cleaning blade mounted under the second load lower than the first load as the load for image formation is allowed to contact the toner image carrier.

The aforementioned procedure allows a pool of a sufficient amount of toner to be formed upstream of the cleaning blade, and ensures presence of toner between the cleaning blade and toner image carrier. This results in a sufficient reduction in the friction between the cleaning blade and toner image carrier.

This arrangement sufficiently suppresses turning over of the cleaning blade or defective cleaning that may occur immediately after the cleaning blade to be mounted has been mounted.

What is claimed is:

1. A cleaning blade mounting method comprising the steps of:

(a) forming a toner layer on a toner image carrier;

(b) moving the toner image carver so that the toner layer reaches a cleaning position at which a cleaning device cleans the toner image carrier;

(c) after bringing a tip of a cleaning blade to be mounted into contact with the toner layer, bringing the tip into contact with the toner image carrier;

(d) mounting the cleaning blade to a temporary position with a second load lower than a first load that is a contact load at a time of an image formation;

(e) moving the cleaning blade with the second load from the temporary position to a final position at which a cleaning is carried out by the cleaning blade;

(f) bringing the cleaning blade with the first load into contact with the toner image carrier; and (g) mounting the cleaning blade to the final position at the time of the image formation.

2. The cleaning blade mounting method of claim 1, further comprising, after the step of mounting the cleaning blade to the final position is carried out, a step of moving the toner image carrier with the first load in a first direction that is a moving direction at the time of the image formation.

3. The cleaning blade mounting method of claim 2, wherein the step of moving the toner image carrier in the first direction, includes moving the toner image carrier at a moving speed lower than that at the time of the image formation.

4. The cleaning blade mounting method of claim 2, further comprising steps of: before the step of mounting the cleaning blade to the temporary position, moving the image carrier in a second direction opposite to the first direction in a state at which the cleaning blade to be replaced is kept in contact with the toner image carrier, and separating the cleaning blade to be replaced from the toner image carrier.

5. An image forming apparatus comprising:

(a) a toner image carrier on which a toner image is carried;

(b) a cleaning device having a plurality of cleaning blades, capable of being in contact with or separated from the toner image carrier and moving the cleaning blades relatively to the image carrier, which cleans the image carrier by bringing selectively any one of the plurality of cleaning blades into contact the image carrier;

(c) a toner layer forming section which forms a toner layer on the toner image carrier;

(d) an image carrier drive section which moves the image carrier so that the toner layer formed on the image carrier is moved with respect to the cleaning device; and (e) a controller which controls a replacement operation of the cleaning blade, wherein the controller causes the toner forming section to form the toner layer on the toner image carrier, causes the image carrier drive section to move the toner image carrier so that the toner layer formed on the toner image carrier reaches a cleaning position of the cleaning device, recedes the cleaning blade to be replaced from the cleaning position, brings a tip of a cleaning blade to be mounted into contact with the toner image carrier after contacting the toner layer, mounts the cleaning blade at a temporary position on the toner image carrier with a second load lower than a first load that is a contact load at a time of an image formation, moves the cleaning blade from the temporary position to a final position with the second load at which a cleaning is carried out by the cleaning blade, and brings the cleaning blade into contact with the toner image carrier with the first load, so that the cleaning blade is mounted to the final position at the time of the image formation.

6. The image forming apparatus of claim 5, wherein after mounting the cleaning blade to the final position, the controller moves the toner image carrier to a first direction which is a moving direction when the image formation is carried out with the first load.

7. The image forming apparatus of claim 6, wherein the controller moves the toner image carrier at a moving speed lower than that at the time of the image formation, when the controller moves the image carrier in the first direction.

* * * * *